US008307517B2

(12) United States Patent
Piermayr et al.

(10) Patent No.: US 8,307,517 B2
(45) Date of Patent: Nov. 13, 2012

(54) SLIDE LOCK FOR JOINING TWO ENDS OF A TEXTILE RIBBON

(75) Inventors: Michael Piermayr, Vienna (AT); Christian Piermayr, Vienna (AT)

(73) Assignee: Harald Platzer GmbH (AT)

( * ) Notice: Subject to any disclaimer, the term of this patent is extended or adjusted under 35 U.S.C. 154(b) by 93 days.

(21) Appl. No.: 12/787,995

(22) Filed: May 26, 2010

(65) Prior Publication Data

US 2011/0061212 A1 Mar. 17, 2011

(51) Int. Cl.
*A44B 11/02* (2006.01)

(52) U.S. Cl. ..... 24/265 R; 24/703.4; 24/703.5; 24/265 A

(58) Field of Classification Search ..... 24/703.1, 24/703.5, 703.3, 703.2, 703.4, 265 R, 265 A, 24/660, 715.6, 614, 136 R, 537, 136 L; 403/274
See application file for complete search history.

(56) References Cited

U.S. PATENT DOCUMENTS 1,283,438 A * 10/1918 Boomer ..... 403/361
1,392,339 A * 10/1921 Kelly ..... 24/715.6
1,420,632 A * 6/1922 Kelly ..... 24/715.6
1,420,657 A * 6/1922 Kelly ..... 24/715.6
1,425,384 A * 8/1922 Kelly ..... 24/715.6
1,546,523 A * 7/1925 Walaschek ..... 24/265 R
1,573,737 A * 2/1926 Norman ..... 403/274
2,003,515 A * 6/1935 Rubin et al. ..... 105/354
RE20,390 E * 6/1937 Rubin et al. ..... 105/354
2,096,897 A * 10/1937 Herrmann ..... 16/110.1
2,099,950 A * 11/1937 Whitehead et al. ..... 403/283
2,101,681 A * 12/1937 Josephs ..... 24/660
2,115,954 A * 5/1938 Johnson ..... 24/265 R
2,126,586 A * 8/1938 Stuber ..... 24/116 A
5,289,613 A * 3/1994 Kohl ..... 16/108
5,383,259 A * 1/1995 McIntire ..... 24/300
5,435,044 A * 7/1995 Ida ..... 24/136 R
7,346,963 B2 * 3/2008 Takahashi ..... 24/136 R
7,574,779 B2 * 8/2009 Takahashi ..... 24/136 L
2005/0166369 A1 * 8/2005 Takahashi ..... 24/136 R
2006/0168770 A1 * 8/2006 Takahashi ..... 24/115 R
2007/0022575 A1 * 2/2007 Takahashi ..... 24/136 R

* cited by examiner

*Primary Examiner* — Robert J Sandy
*Assistant Examiner* — Abigail E Morrell
(74) *Attorney, Agent, or Firm* — Seyfarth Shaw LLP

(57) ABSTRACT

A slide lock for joining two ends of a textile ribbon, including an external sleeve having a cavity; and a locking part having at least one tip and mounted in the cavity of the external sleeve; wherein the external sleeve has an opening with stops for the locking part and an opening allowing the insertion of the locking part, locking portions for cooperating with the stops to retain the locking part in the cavity are further provided in the external sleeve.

7 Claims, 4 Drawing Sheets

SLIDE LOCK FOR JOINING TWO ENDS OF A TEXTILE RIBBON

BACKGROUND OF THE INVENTION

The present invention relates to a slide lock for joining two ends of a textile ribbon.

In numerous applications it is desirable to join the ends of a ribbon via a lock to form a loop identifier around the wrist of a user. For example, when taking part in an event, the textile ribbon can be used as non-transferable "entry ticket" to the ground (s) of the event. One of the first configurations of such an entry-right ribbon as a lock is a simple metallic sleeve that after the adjustment of the loop to suit the desired size is deformed with a corresponding tool by clamping the ends of the ribbon at this position. A disadvantage of this solution is that a tool is required to lock and fix the position of the lock and that the force, used for the deforming of the sleeve, determines the robustness of the clamping lock. As an improvement, a lock having a push-in part is provided, wherein an external sleeve is a cylindrical sleeve and the push-in part consists of two semi-cylindrical push-in part elements, and during the assembly the two halves of the push-in part can be simply folded to be pushed in the external sleeve. Each push-in part element is provided with at least one tip, and when in use, the two ends of textile ribbon are firstly drawn through the external sleeve, and then into the push-in part elements, and the two push-in part elements are then folded and pushed into the external sleeve such that the textile ribbon is pressed and thus fixed by the tips, and the length of the textile ribbon can still be regulated along the tip direction. However, in this lock structure, there are too many active parts which may be lost easily during transportation and storage and also have too many assembly steps. It is thus inconvenient for use.

SUMMARY OF THE INVENTION

Having the state of the prior art and its attendant shortages, it is an object of the present invention to provide a slide lock for joining two ends of a textile ribbon which has compact structure and is convenient for use.

The above object of the present invention is achieved by the following technical solutions: a lock for joining two ends of a textile ribbon comprises: an external sleeve having a cavity; and a locking part having at least one tip and mounted in the cavity of the external sleeve; wherein the external sleeve has an opening with stops for the locking part and an opening allowing the insertion of the locking part, locking portions for cooperating with the stops to retain the locking part in the cavity are further provided in the external sleeve.

The locking part is directly fixed in the external sleeve via the stops and the locking portions. The two ends of the textile ribbon can be drawn through the openings of the sleeve. The tips of the locking part penetrate into the textile ribbon to fix the ribbon during the textile ribbon being drawn conversely. The slide lock has less active parts and compact structure, and it can directly be used for fixing the textile ribbon without the need of complicated preassembly.

Preferably, the locking portion may be a locking block on the inner wall of the cavity.

Alternatively, the locking portion may be a recess on the inner wall of the cavity.

Preferably, the stops are provided at one end of the external sleeve, the locking portions are provided on the inner wall of the cavity near said one end of the external sleeve, and locking hooks for buckling with the locking portions are extended outwards from the locking part. Because the locking part has hooks for enabling itself to be firmly buckled in the locking portions of the sleeve and will not break when being slid. Moreover, it is very easy to insert the locking part into the sleeve due to the simple opening of the sleeve on the other end.

Alternatively, the stops are provided at one end of the external sleeve, the locking portions are provided at the other end of the external sleeve, and the locking part is entirely retained between the stops and the locking portions.

Preferably, the locking part is a single piece, and has an opening for allowing the passing through of the ribbon and corresponding to the opening of the external sleeve at one end where the stops are located, and has said at least one tip at the other end.

Alternatively, the locking part is a single piece, and has an opening at each end corresponding to each of the openings of the external sleeve respectively and has said at least one tip between the openings of the locking part.

Preferably, the locking part has a first locking part portion and a second locking part portion opposite to the first locking part portion with a flexible portion connected therebetween. In this manner, the first locking part portion and the second locking part portion can be manufactured in one, and the locking part is obtained by folding the first blocking part portion relative to the second blocking part portion along the flexible portion. Preferably, the opening for allowing the passing through of the ribbon is formed on the flexible portion, therefore when the locking part is made of a metal sheet, the flexible portion may be obtained by simply stamping the opening out of the metal sheet.

Preferably, the first locking part portion is provided with at least one tip, the second locking part portion is also provided with at least one tip that is in a staggered manner with respect to the at least one tip of the first locking part portion. In this way, the resistance is reduced during the textile ribbon being drawn through the locking part. Moreover, the tips penetrate into the textile ribbon in a staggered manner during the textile ribbon being drawn conversely, and therefore the resistance is balanced and the deformation of the textile ribbon is reduced. Furthermore, the at least one tip preferably extends slightly beyond the center between the first locking part portion and the second locking part portion such that the tips penetrate more firmly into the textile ribbon to fix the ribbon during the textile ribbon being drawn conversely.

Preferably, the cavity of the sleeve has a substantially rectangular cross section. In this manner, the locking part will not be rotated or moved relative to the sleeve easily and is thus stably locked within the sleeve.

Preferably, the stops are symmetrically provided at two sides of one end of the external sleeve, the locking portions are symmetrically provided on the other end of the external sleeve.

Alternatively, the stops are symmetrically provided at two sides of one end of the external sleeve, and the locking portions are symmetrically provided on the inner wall of the cavity near the one end of the external sleeve.

With the present invention, the slide lock is compact in structure and without active parts, and it is unnecessary to use a special tool. It is thus convenient in use and for transportation.

BRIEF DESCRIPTION OF THE DRAWINGS

Many aspects of the invention can be better understood in the following embodiments with reference to the accompanying drawings, wherein.

DETAILED DESCRIPTION OF THE PREFERRED EMBODIMENT

Figure 1:
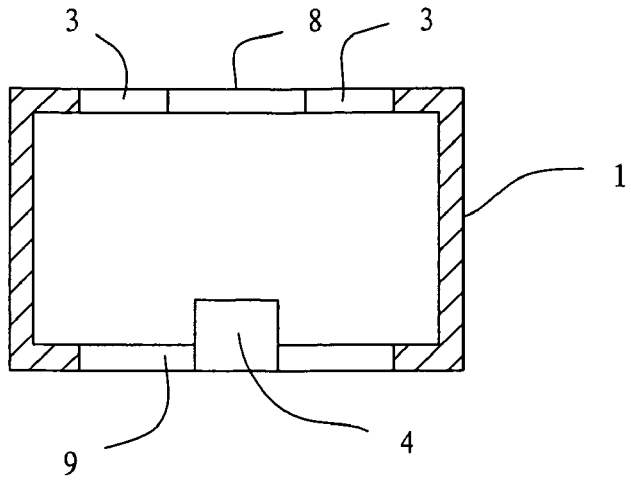
FIG. 1 is a sectional view of the external sleeve according to a first embodiment of the present invention.
Figure 2:
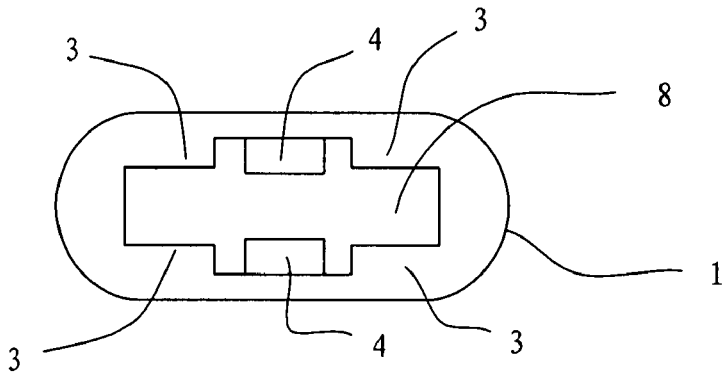
FIG. 2 is a top view of the external sleeve according to the first embodiment of the present invention.
Figure 3:
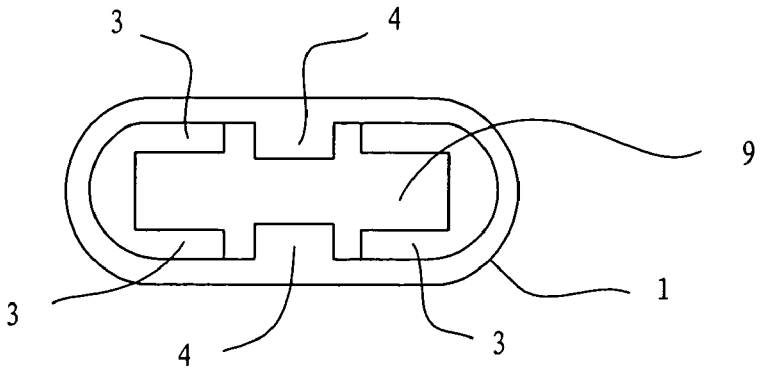
FIG. 3 is a bottom view of the external sleeve according to the first embodiment of the present invention.

Referring to FIGS. 1 to 6, a slide lock for joining two ends of a textile ribbon according to a first embodiment is shown. The lock comprises an external sleeve 1 and a locking part 2 mounted in the external sleeve 1. The external sleeve 1 has openings 8, 9 respectively on both ends thereof. The cavity of the sleeve has a substantially rectangular cross section. In this manner, the locking part will not be rotated or moved relative to the sleeve easily and is thus stably locked within the sleeve. The two ends of the textile ribbon can be inserted into one of the openings and drawn out from the other one of the openings. Referring to FIGS. 2 and 3, stops 3 are symmetrically arranged on the inner wall at one end of the external sleeve 1. The gap of the opening 8 is smaller than that of the opening 9. Locking blocks 4 are symmetrically provided on the inner wall at the end of the external sleeve 1 where the opening 9 is located. Therefore, a cavity is defined between the locking blocks 4 and the stops 3. The locking blocks 4 extends towards the cavity and cooperates with the stops 3 to retain the locking part 2 in the cavity. The slide lock is thus compact in structure and without active parts, and it is unnecessary to use a special tool to join the two ends of the ribbon.

Figure 5:
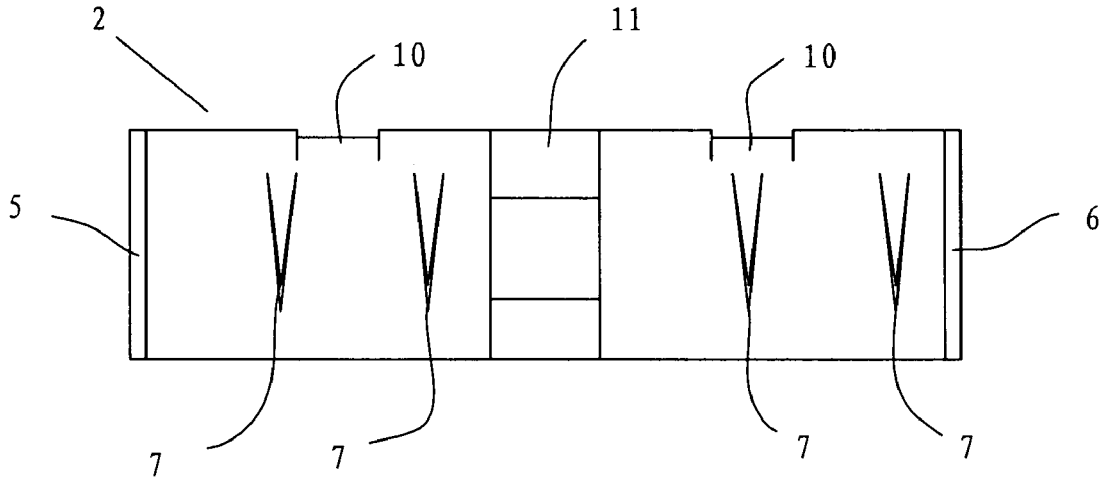
FIG. 5 is a locking part of the first embodiment of the present invention.
Figure 6:
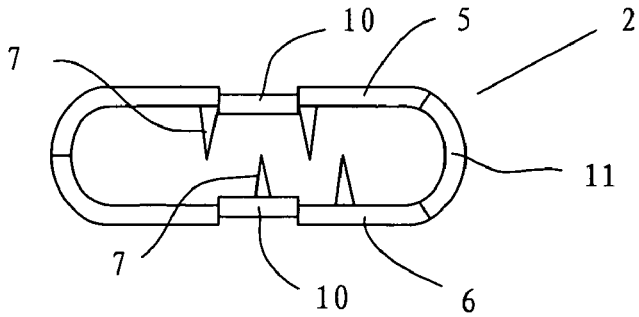
FIG. 6 is a schematic structural view of the locking part after folding.

Referring to FIGS. 5 and 6, in this embodiment, the locking part 2 is made of a metal sheet. The locking part 2 consists of a first locking part portion 5 and a second locking part portion 6, which are connected together by a flexible portion 11. Two tips 7 are provided on each of the first locking part portion 5 and the second locking part portion 6 and extend outwards. After folding along the flexible portion 11, the four tips 7 are staggered with respect to each other and extend to the interior. On the same side, a slope 10 corresponding to the position of the locking block 4 is provided on each of the first locking part portion 5 and the second locking part portion 6, which facilitates the insertion of locking part 2 into the external sleeve 1.

Figure 4:
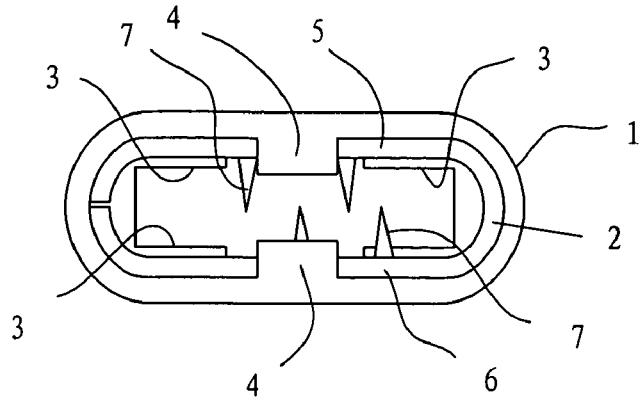
FIG. 4 is a top view of a slide lock according to the first embodiment of the present invention.

Referring to FIG. 4, the locking part 2 is entirely retained between the stop 3 and the locking block 4. The tips 7 on the first locking part portion 5 and on the second locking part portion 6 are arranged in a staggered manner with respect to each other. For the sake of clarity, the textile ribbon is not shown in the figures. When in use, both ends of the textile ribbon are drawn through the locking part 2 along the extending direction of the tips 7. Then, the textile ribbon is drawn conversely such that the tips 7 penetrate into the textile ribbon to stop the movement of the textile ribbon relative to the locking part 2 and the external sleeve 1 and result in the locking, so that a loop is created. However, the textile ribbon can still be drawn out along the extending direction of the tips 7.

Now, referring to FIGS. 7 to 12, a lock for joining two ends of a textile ribbon according to a second embodiment is shown. The lock comprises an external sleeve 1 and a locking part 2. The external sleeve 1 has an opening 12 with stops 3 for the locking part and an opening 14 allowing the insertion of the locking part 2. Locking blocks 4 extending towards the cavity and cooperating with the stops 3 to retain the locking part 2 in the cavity are further provided in the external sleeve 1. The cavity of the sleeve has also a substantially rectangular cross section.

Figure 12:
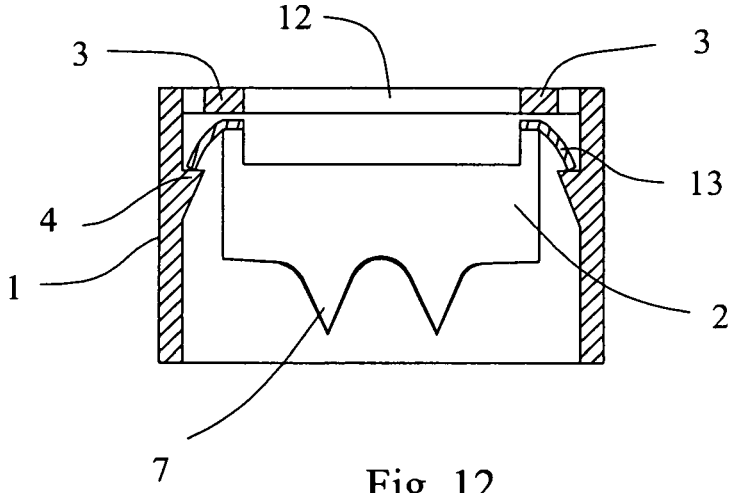
FIG. 12 is a schematic assembly view of the locking part shown in FIG. 9 and the external sleeve shown in FIG. 7.

As shown in FIG. 12, the stops 3 are, preferably symmetrically, provided at one end of the external sleeve 1. The locking blocks 4 are, preferably symmetrically, provided on the inner left and right sidewalls of the cavity respectively near said one end of the external sleeve 1. Locking hooks 13 for buckling with the locking blocks 4 are extended outwards from the locking part 2 and correspond to the positions of the locking blocks 4. As it is obvious to a person skilled in the art, the locking blocks 4 may be replaced by recesses which also cooperate with the locking hooks 13, providing the same effect that the locking part 2 is locked in the cavity.

Figure 7:
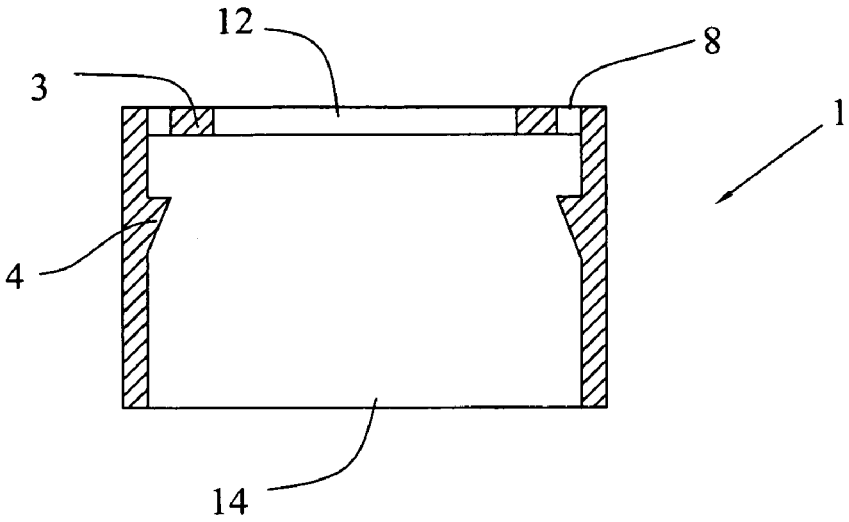
FIG. 7 is a schematic sectional view of an external sleeve of a second embodiment of the present invention.
Figure 8:
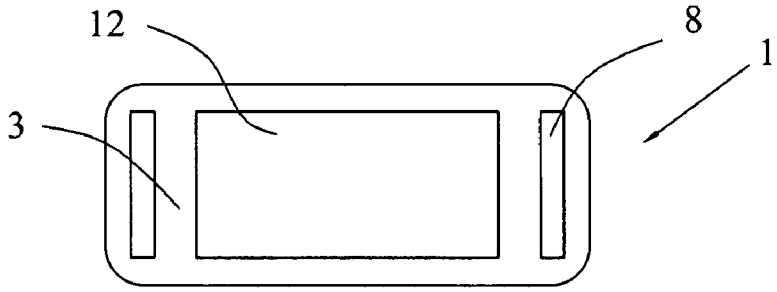
FIG. 8 is a schematic top view of the external sleeve shown in FIG. 7.

As shown in FIGS. 7 and 8, an opening 8 is formed on the bottom of the sleeve 1 corresponding to the locking block 4 so as to enable a mold portion to pass through the opening 8 such that the locking block 4 may be formed after molding.

Figure 9:
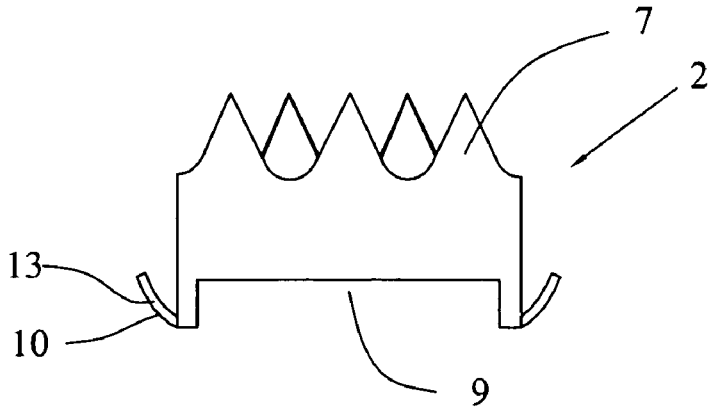
FIG. 9 is a schematic front view of a locking part of the second embodiment of the present invention.
Figure 10:
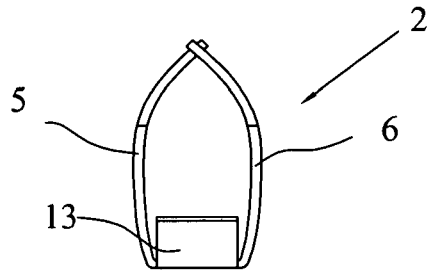
FIG. 10 is a schematic side view of the locking part shown in FIG. 9.
Figure 11:
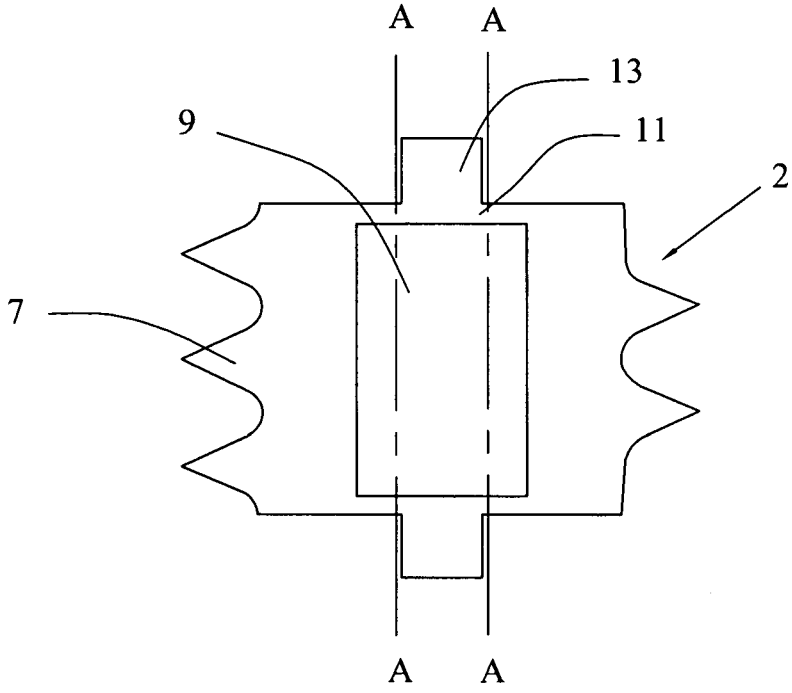
FIG. 11 is a schematic view of the locking part in expanded state before folding.

Referring to FIGS. 9 to 11, the locking part 2 is a single piece, and has an opening 9 for allowing the passing through of the ribbon and corresponding to the opening 12 of the external sleeve 1 at one end and has five tips 7 at the other end. The locking part 2 has a first locking part portion 5 with three tips 7, and a second locking part portion 6 with two tips 7 and opposite to the first locking part portion 5. The first locking part portion 5 is connected to the second part portion 6 by a flexible portion 11. In this embodiment, the locking part 2 is made of a metal sheet. The opening 9 for allowing the passing through of the ribbon is formed on the flexible portion 11, therefore, the flexible portion 11 may be obtained by simply stamping the opening 9 out of the metal sheet. Thus, the locking part shown in FIG. 9 is obtained by folding the locking part in expanded state, as shown in FIG. 11 along the flexible portion 11, i.e. along the A-A lines. The locking hooks 13 are formed on two opposite sides of the opening 9 for allowing the passing through of the ribbon, and may be obtained together with the opening 9 in one step by stamping.

The tips 7 extend slightly beyond the center between the first locking part portion 5 and the second locking part portion 6 such that the tips 7 penetrate more firmly into the textile ribbon to fix the ribbon during the textile ribbon being drawn conversely.

As it is better seen in FIGS. 9 and 12, a slope 10 is formed on the locking hook 13, so that the locking part can be inserted into the sleeve 1 more easily.

Compared with the structure of the first embodiment, in the lock of the second embodiment the locking part has two hooks for enabling itself to be firmly buckled in the locking blocks on the inner left and right sides of the sleeve and will not break when being slid, this happed sometimes with the structure of the first embodiment as the locking part popped out. Moreover, it is far easier to insert the locking part into the sleeve due to the simpler opening of the sleeve. In addition, the locking blocks are close to the stops in the second embodiment, the weak portion of the mold for forming the locking block is thus relative short in length such that it is not easy to break during the mold opening and closing strokes. Therefore, the mold for forming the external sleeve will have a much longer lifetime.

It should be emphasized that the above-described embodiments of the present invention, particularly, any preferred embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A slide lock for joining two ends of a textile ribbon, comprising:

an external sleeve having a cavity; and a locking part having a tip and mounted in the cavity of the external sleeve;

wherein the external sleeve includes a first opening with stops for the locking part and a second opening allowing for insertion of the locking part, and further includes locking portions adapted to cooperate with the stops to retain the locking part in the cavity, wherein the stops are provided at a first end of the external sleeve, the locking portions are provided at a second end of the external sleeve, and the locking part is retained between the stops and the locking portions.

2. The slide lock of claim 1, wherein the locking portions are locking blocks disposed on an inner wall of the cavity.

3. The slide lock of claim 1, wherein the locking part is a single piece with a first locking part end and a second locking part end, and has a first and second locking part opening at the first and second locking part ends, respectively, corresponding to each of the first and second openings of the external sleeve, and includes the tip between the first and second locking part openings.

4. The slide lock of claim 1, wherein the locking part includes a first locking part portion and a second locking part portion opposite to the first locking part portion with a flexible portion connected therebetween.

5. The slide lock of claim 4, wherein the first locking part portion includes the tip, the second locking part portion is provided with a second tip that is disposed in a staggered manner with respect to the tip of the first locking part portion.

6. The slide lock of claim 1, wherein the cavity of the sleeve includes a rectangular cross section.

7. The slide lock of claim 1, wherein the stops are symmetrically provided at two sides of the first end of the external sleeve, and the locking portions are symmetrically provided on the second end of the external sleeve.

* * * * *